US006083181A

United States Patent [19]

Marcantoni

[11] Patent Number: 6,083,181

[45] Date of Patent: Jul. 4, 2000

[54] MASSAGING DEVICE FOR INSERTION IN THE BACK OF MASSAGE CHAIRS OR THE LIKE

[75] Inventor: Egidio Marcantoni, Pesaro, Italy

[73] Assignee: Ciar S.r.l., Pesaro, Italy

[21] Appl. No.: 09/124,746

[22] Filed: Jul. 29, 1998

[51] Int. Cl.[7] ..... A61H 15/00

[52] U.S. Cl. ..... 601/99; 601/90; 601/98; 601/115

[58] Field of Search ..... 601/97, 98, 99, 601/100, 101, 102, 103, 112, 113, 115, 116, 89, 90, 91, 92, 93, 94

[56] References Cited

U.S. PATENT DOCUMENTS

| | | | |
|---|---|---|---|
| 4,718,408 | 1/1988 | Barreiro . | |
| 5,038,757 | 8/1991 | Yamasaki | 601/102 |
| 5,052,376 | 10/1991 | Yamasaki . | |
| 5,179,940 | 1/1993 | Barreiro | 601/99 |
| 5,233,973 | 8/1993 | Gill et al. | 601/103 |
| 5,460,598 | 10/1995 | Yamasaki et al. | 601/99 |
| 5,464,382 | 11/1995 | Wang . | |
| 5,792,080 | 8/1998 | Ookawa et al. | 601/99 |
| 5,807,288 | 9/1998 | Wu | 601/100 |
| 5,971,944 | 10/1999 | Chang | 601/99 |

FOREIGN PATENT DOCUMENTS

| | | | |
|---|---|---|---|
| 406125954 | 5/1994 | Japan | 601/98 |
| 1400473 | 7/1975 | United Kingdom . | |
| 9217141 | 10/1992 | WIPO . | |

*Primary Examiner*—Richard J. Apley
*Assistant Examiner*—Justine R. Yu
*Attorney, Agent, or Firm*—Guido Modiano; Albert Josif; Daniel O'Byrne

[57] ABSTRACT

A massaging device for insertion in the back of massage chairs or the like, comprising a frame which supports, so that they can rotate about their respective axes, an upper shaft and a lower shaft having parallel and substantially horizontal axes and eccentric portions. Two arms are provided, each arm supporting a massage wheel which can rotate about its own almost horizontal axis, and, proximate to one of its ends, the corresponding massage wheel and being connected, proximate to its opposite end, to an eccentric portion of the upper shaft and, at an intermediate region, to an eccentric portion of the lower shaft. Elements are also provided for rotating the shafts about their respective axes to produce an alternating movement of the massage wheels in a substantially horizontal direction and in a substantially vertical direction, the actuation elements comprising an upper gearmotor which actuates the upper shaft and a lower gearmotor which actuates the lower shaft.

16 Claims, 5 Drawing Sheets

MASSAGING DEVICE FOR INSERTION IN THE BACK OF MASSAGE CHAIRS OR THE LIKE

BACKGROUND OF THE INVENTION

The present invention relates to a massaging device for insertion in the back of massage chairs or the like.

Conventional massaging devices for insertion in the back of massage chairs or the like generally comprise a frame which supports, so that they can rotate about their respective axes, an upper shaft and a lower shaft which are arranged so that their axes are parallel and substantially horizontal. The upper shaft and the lower shaft have, at their two opposite longitudinal ends, eccentric portions having a circular cross-section and which can be likened to cranks, each portion rotatably engaging an arm which supports, at its opposite end, a wheel which can rotate freely about its own axis, which is usually slightly inclined with respect to a horizontal direction which is parallel to the axes of the upper and of the lower shafts.

Each one of the arms is pivoted, proximate to one of its intermediate portions, to an eccentric portion of the lower shaft which can also be likened to a crank.

Each one of the arms is connected to the eccentric portion of the lower shaft by a linkage. The linkage is articulated in an intermediate point so as to allow to vary its useful length and connect it to the corresponding eccentric portion of the lower shaft by means of a spherical joint.

The axis of the eccentric portions of the upper shaft which engage the arms is slightly inclined with respect to the axis of the upper shaft. As a consequence of the geometry of the eccentric portions, the rotary actuation of the upper and of the lower shafts causes an oscillation of the wheels, which constitute the parts of the massaging device that act on the back of the user, about a respective axis which passes through the point where the axis of the corresponding eccentric portion of the upper shaft intersects the corresponding axis of the upper shaft; in other words, a movement in a horizontal direction occurs, thus producing the massage known as "stretching", and a vertical movement, producing the massage known as "tapping".

The rotary actuation of the upper and of the lower shafts about their respective axes is achieved by means of a single motor which, by means of a belt drive, turns a transmission shaft arranged transversely to the upper and to the lower shafts and connected thereto by means of two pairs of helical gears. The helical gears arranged on the transmission shaft are connected to the transmission shaft by unidirectional bearings, i.e., bearings which can only rotate in one direction, allowing the corresponding gear to rotate freely with respect to the transmission shaft, and which lock in the opposite direction, rigidly rotationally coupling the corresponding gear to the transmission shaft.

The bearing of one of the gears arranged on the transmission shaft rotates freely in one direction, whilst the bearing of the other gear arranged on the transmission shaft rotates freely in the opposite direction.

In this manner, by means of a single motor which is actuated once in one direction and once in the other direction, the upper and lower shafts are rotated alternatively, the upper shaft producing the oscillating motion of the massage wheels, i.e., their movement in a substantially horizontal direction, the lower shaft moving the massage wheels substantially in a vertical direction.

This device has the drawback of being very noisy during operation.

Moreover, as a consequence of the alternating actuation of the upper and of the lower shafts, i.e., of a nonsimultaneous actuation of the two shafts, the two stretching and tapping massage functions are performed separately.

SUMMARY OF THE INVENTION

A principal aim of the present invention is to solve the above problems, providing a massaging device for insertion in the back of massage chairs or the like, which, when required, allows to simultaneously achieve movement of the massage wheels in a substantially horizontal direction and in a substantially vertical direction, simultaneously achieving both stretching massage and tapping massage.

Within the scope of this aim, an object of the present invention is to provide a massaging device which is very quiet during operation.

Another object of the present invention is to provide a massaging device which is practically maintenance-free.

Another object of the present invention is to provide a massaging device wherein friction in the transmission of motion is minimized and which can use small and accordingly economical actuation motors.

Another object of the present invention is to provide a massaging device which can be manufactured with competitive costs.

This aim, these objects, and others which will become apparent hereinafter are achieved by a massaging device for insertion in the back of massage chairs or the like, comprising: a frame which supports, so that they can rotate about their respective axes, an upper shaft and a lower shaft having parallel and substantially horizontal axes and eccentric portions; two arms, each whereof supports a massage wheel which can rotate about its own almost horizontal axis; each one of said arms supporting, proximate to one of its ends, the corresponding massage wheel and being connected, proximate to its opposite end, to an eccentric portion of said upper shaft and, at an intermediate region, to an eccentric portion of said lower shaft; means being provided for rotating said shafts about their respective axes for an alternating movement of said massage wheels in a substantially horizontal direction and in a substantially vertical direction, characterized in that said actuation means comprise an upper gearmotor which actuates said upper shaft and a lower gearmotor which actuates said lower shaft.

BRIEF DESCRIPTION OF THE DRAWINGS

Further characteristics and advantages of the present invention will become apparent from the following detailed description of two preferred but not exclusive embodiments of the massaging device according to the invention, illustrated only by way of non-limitative example in the accompanying drawings, wherein:

FIG. 1 is a schematic front elevation view of the massaging device according to the present invention in an operating position, illustrating the movement of the massage wheels in a predominantly vertical direction;

FIG. 2 is a schematic lateral elevation view of the device according to the present invention, in the operating position corresponding to the one shown in FIG. 1;

FIG. 3 is a schematic front elevation view of the device according to the present invention in another operating position, illustrating the movement of the massage wheels in a predominantly horizontal direction;

FIG. 4 is a schematic lateral elevation view of the device according to the invention in the operating position corresponding to the one shown in FIG. 2;

FIG. 5 is a schematic front elevation view of the massaging device according to the present invention;

FIG. 6 is a schematic front elevation view of the device according to the present invention in an operating position, illustrating the movement of the massage wheels in a predominantly horizontal direction;

FIG. 7 is a schematic front elevation view of the device according to the present invention in an operating position, illustrating the movement of the massage wheels in a predominantly vertical direction;

FIG. 8 is a schematic lateral elevation view of the device according to the present invention, illustrating the movement of the massage wheels in a predominantly vertical direction.

DESCRIPTION OF THE PREFERRED EMBODIMENTS

Figure 1:
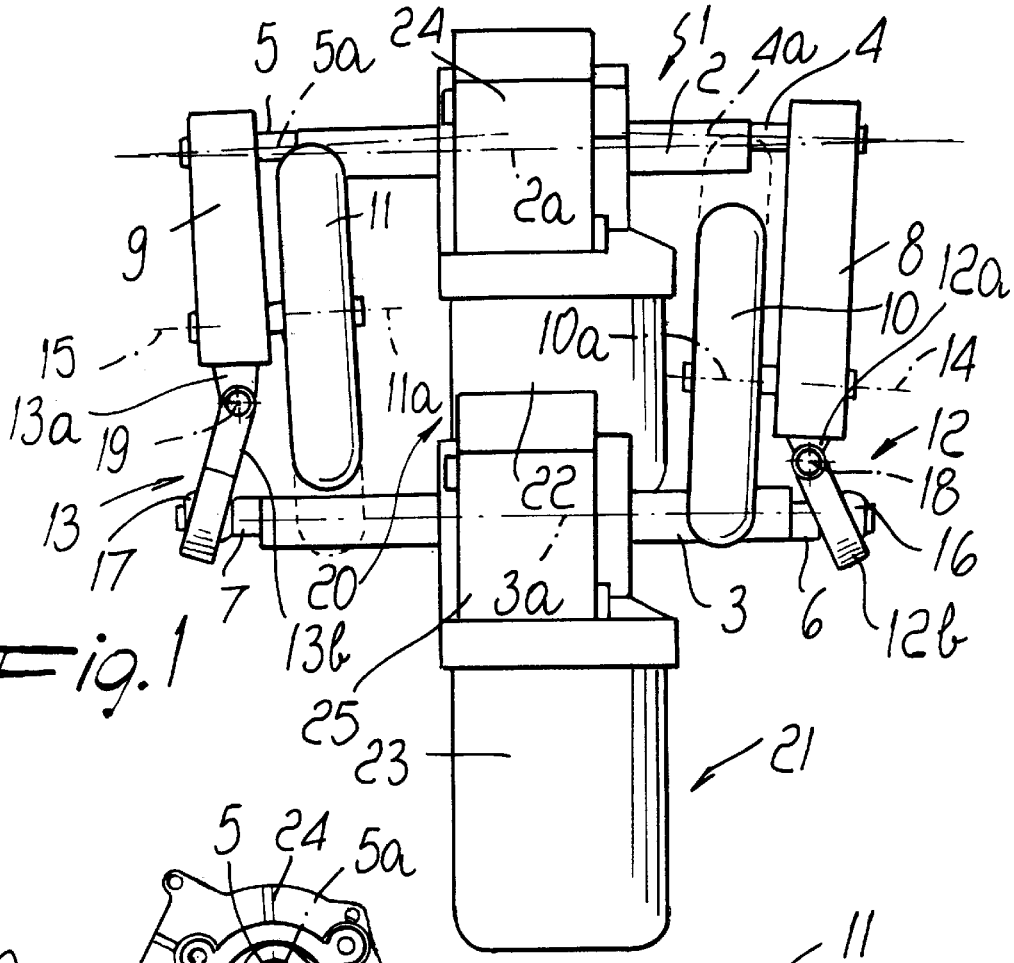
FIGS. 1 to 4 are views of the device according to the present invention in the first embodiment, and more particularly.
Figure 2:
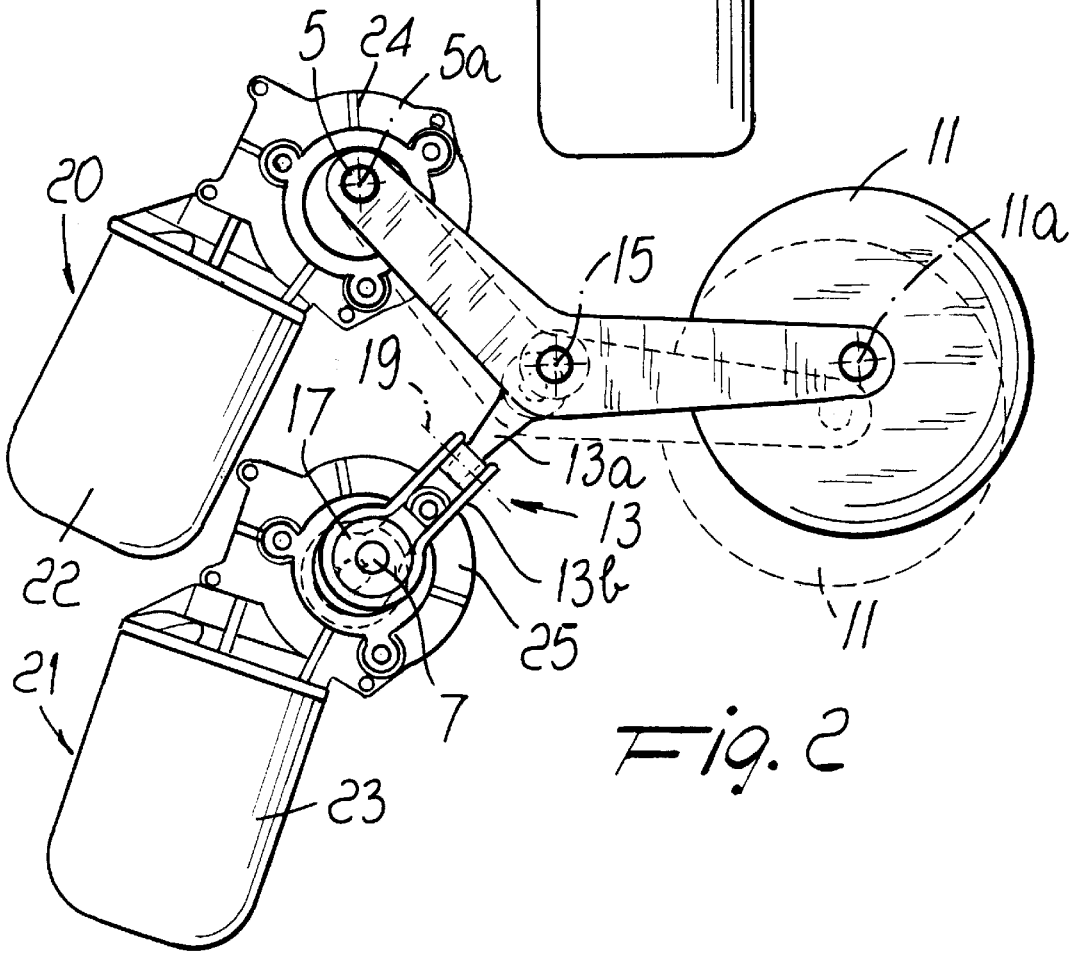

With reference to the above figures, the device according to the present invention, generally designated by the reference numerals 1 and 1*a* in its two illustrative embodiments, comprises in a per se known manner a frame, not shown for the sake of simplicity, which supports, so that they can rotate about their respective axes 2*a* and 3*a*, an upper shaft 2 and a lower shaft 3 which are substantially parallel to each other and are arranged horizontally.

The upper shaft 2 has, at its longitudinal ends, two eccentric portions 4 and 5 which have a circular transverse cross-section and can in practice be likened to cranks.

Conveniently, the axes 4*a* and 5*a* of the eccentric portions 4 and 5 are inclined with respect to the axis 2*a* of the upper shaft 2.

The eccentricity of the eccentric portions 4 and 5 is provided on a same side of the axis. 2*a* of the upper shaft 2; i.e., the two eccentric portions 4 and 5 are in step with respect to each other.

In the first embodiment, the lower shaft 3, too, has at its longitudinal ends two eccentric portions 6 and 7 which are also substantially circular and can be likened to two cranks.

Conveniently, the eccentricity of the eccentric portion 6 is opposite to the eccentricity of the eccentric portion 7; i.e., the two eccentric portions 6 and 7 are angularly offset with respect to each other about the axis 3*a* of the lower shaft 3 by an angle of 180°.

In the second embodiment, the two eccentric portions of the lower shaft, designated by the reference numerals 106 and 107, are constituted by two cams which are fixed to the lower shaft 3 proximate to its axial ends.

Each cam 106 and 107 is substantially elliptical in transverse cross-section and the two cams are mounted on the shaft so as to be angularly offset, about the axis 3*a*, by an angle of substantially 90°.

The device according to the present invention, in its two embodiments, comprises two arms 8 and 9, each whereof rotatably supports a massage wheel 10 and 11 about its respective axis 10*a* and 11*a*.

The arms 8 and 9 support the corresponding massage wheel 10 and 11 so that it can rotate freely at one of their ends and are pivoted, at their opposite end, to one of the eccentric portions 4 and 5 of the upper shaft 2.

Moreover, each arm 8 and 9 is connected, by means of an intermediate region of its extension, to one of the eccentric portions 6, 7, 106, 107 of the lower shaft 3.

Each one of the arms 8 and 9, in the two embodiments, is arranged on a plane which is substantially perpendicular to the axis 4*a*, 5*a* of the corresponding eccentric portion 4, 5 of the upper shaft 2 to which they are connected.

In the first embodiment, the connection of the intermediate portion of each arm 8 and 9 to the corresponding eccentric portion 6 and 7 of the lower shaft 3 is provided by means of a linkage 12 and 13 which is pivoted, at one of its ends, to an intermediate portion of the corresponding arm 8 and 9 about an axis 14 and 15 which is substantially parallel to the axis 10*a*, 11*a* of the massage wheel 10, 11 which is supported by the arm 8, 9 and is connected to the eccentric portion 6 and 7 of the lower shaft 3 by means of a spherical joint 16, 17.

Each linkage 12, 13 is composed of two portions, designated respectively by the reference numerals 12*a*, 12*b*, 13*a*, and 13*b*, which are pivoted to each other in an intermediate region of the linkage about an axis 18, 19 which is substantially perpendicular to the axis 14, 15 and so as to allow to vary the useful length of the linkage and allow the oscillation of the arm 8, 9 produced by the inclination of the axis 4*a*, 5*a* with respect to the axis 2*a* of the upper shaft 2.

In the second embodiment, connection of the arms 8 and 9 to the lower shaft 3 is provided by cam followers, which are fitted on the arms 8 and 9 and rest against the profile of the cams 106 and 107. More particularly, each one of two arms 8 and 9 supports, in an intermediate region of its extension, a cam follower constituted by a wheel 112, 113 resting on the corresponding cam 106, 107.

According to the invention, means are provided for rotating the upper shaft 2 and the lower shaft 3 about their respective axes 2*a*, 3*a*; the actuation means are constituted by an upper gearmotor 20, which actuates the upper shaft 2, and by a lower gearmotor 21, which actuates the lower shaft 3.

More particularly, each gearmotor 20, 21 is constituted by an electric motor 22, 23 and by a reduction unit 24, 25 of the worm screw-helical gear type, wherein the worm screw is connected to the output shaft of the corresponding electric motor 22, 23 and the helical gear is keyed on an intermediate portion of the upper shaft 2 and of the lower shaft 3 respectively.

In this manner, the parts required to transmit motion from the motors 22, 23 to the shafts 2 and 3 are reduced to a minimum, achieving particularly quiet operation.

The two motors 20, 21 can also be actuated simultaneously or alternately according to massage requirements.

For the sake of completeness in description, it should be noted that in the second embodiment of the device the contact of the wheels 112,, 113 with the cams 106, 107 is ensured in any condition by springs 114 which are stretched between the arms 8, 9 and the body of the motor 22 or another fixed locator element.

Operation of the massaging device according to the present invention is as follows.

Figure 3:
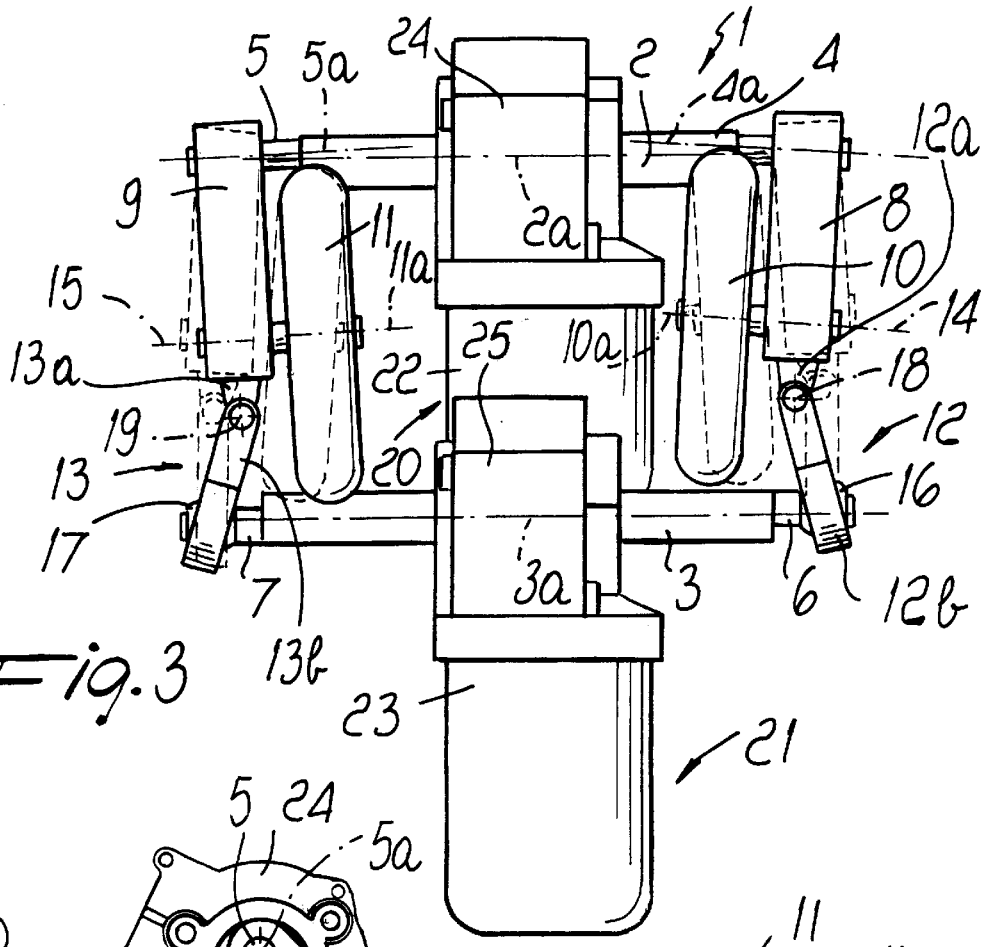
Figure 4:
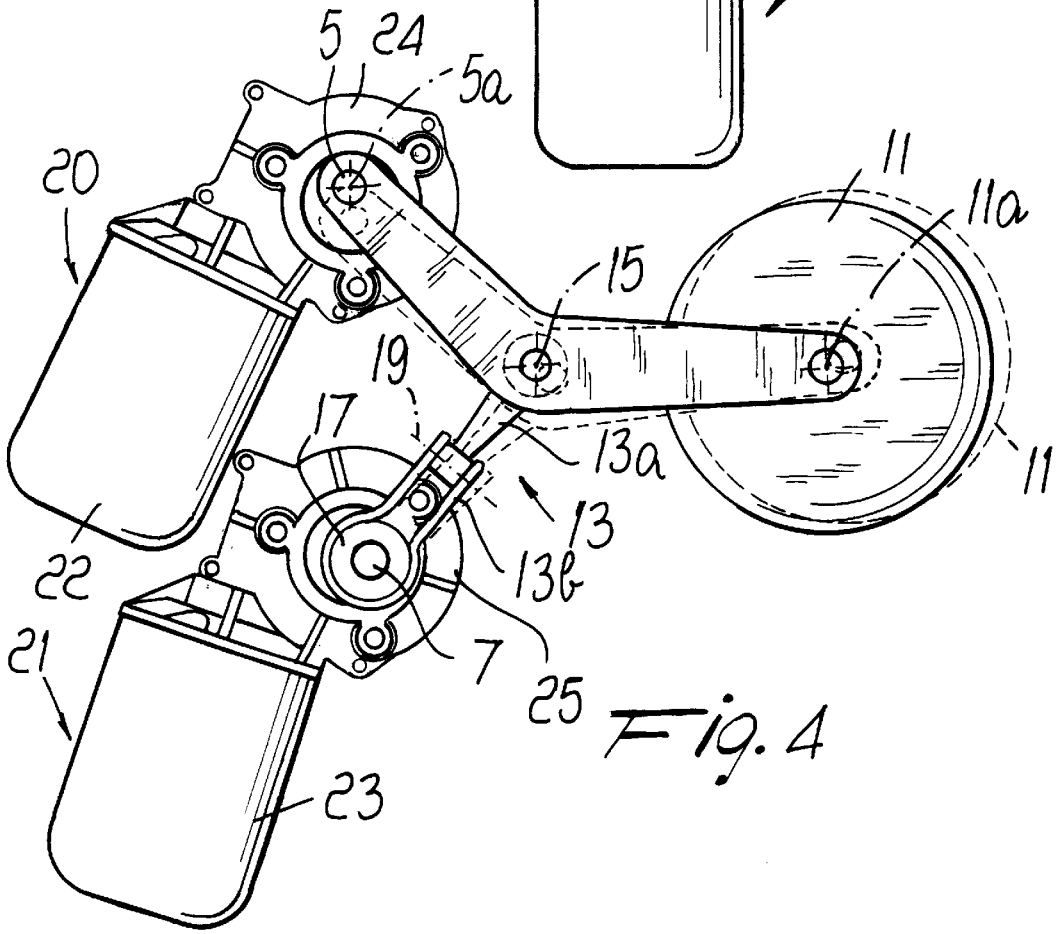
Figure 5:
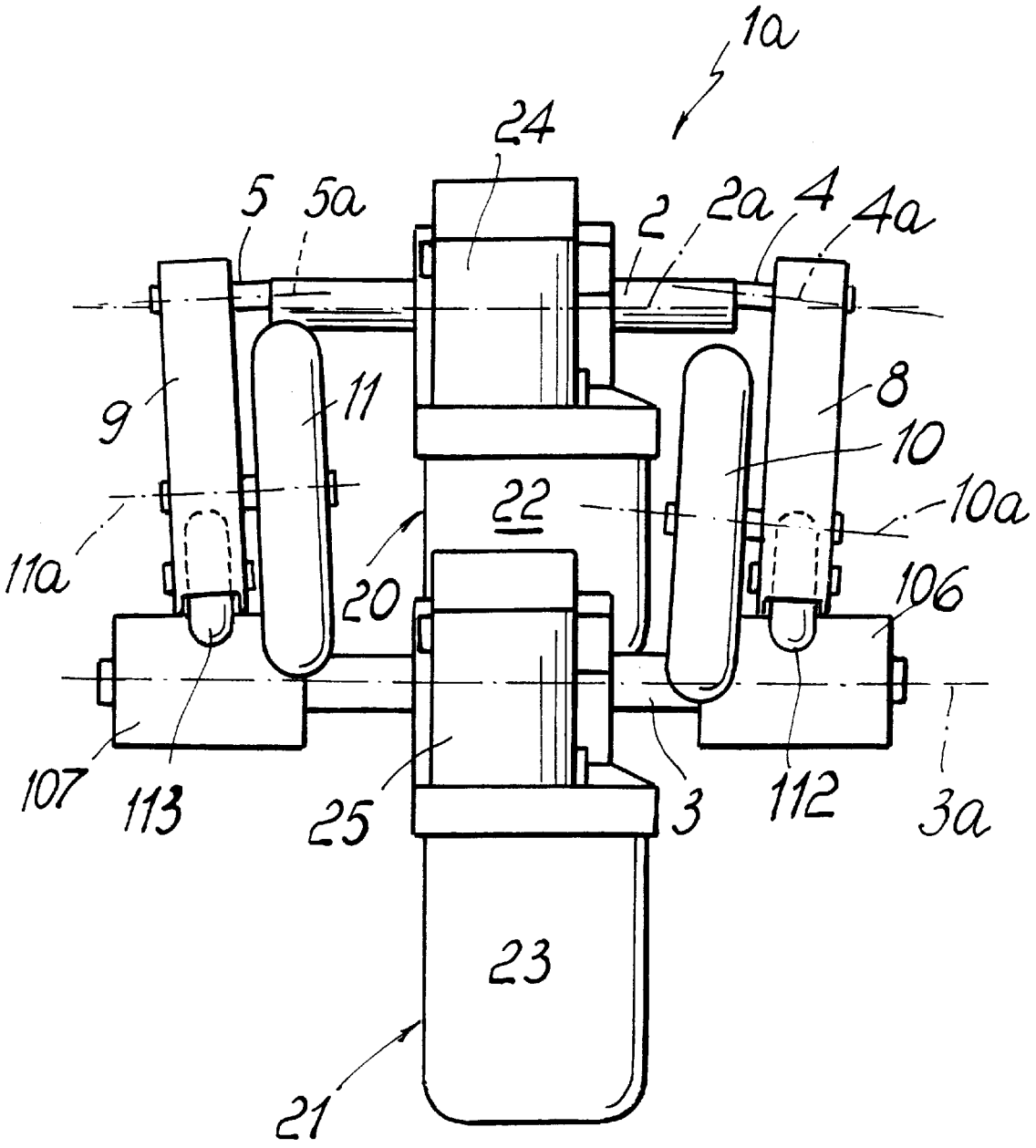
FIGS. 5 to 8 illustrate the device according to the present invention according to a second embodiment, and more particularly.
Figure 7:
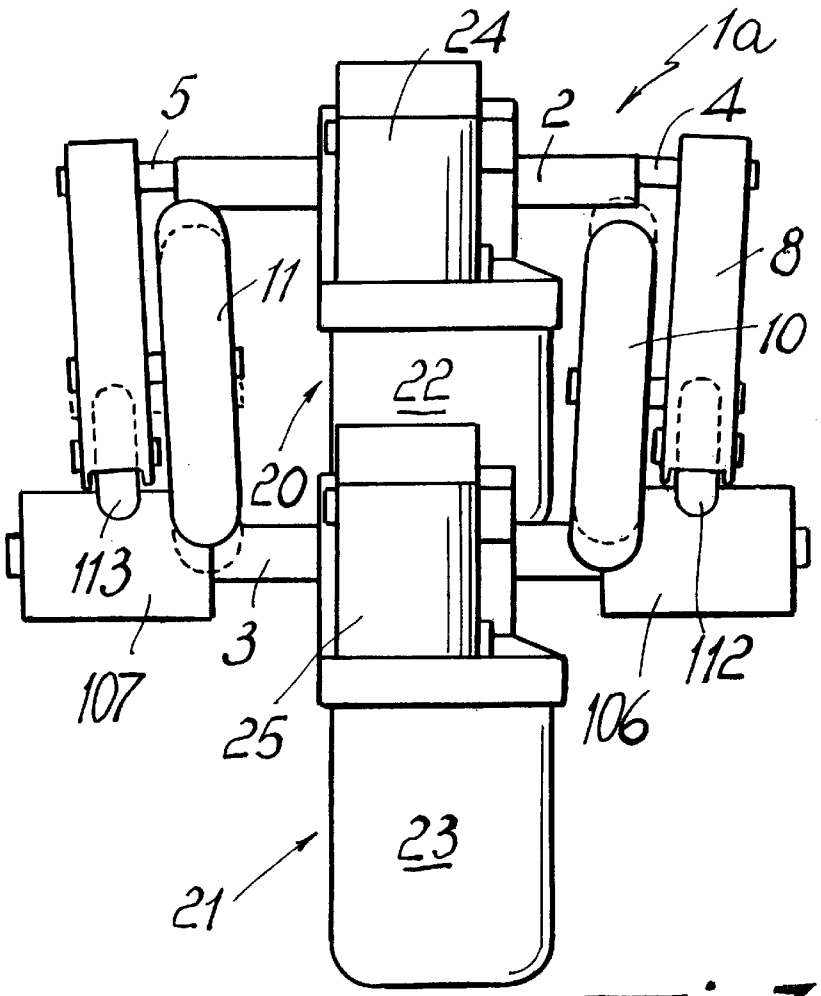
Figure 6:
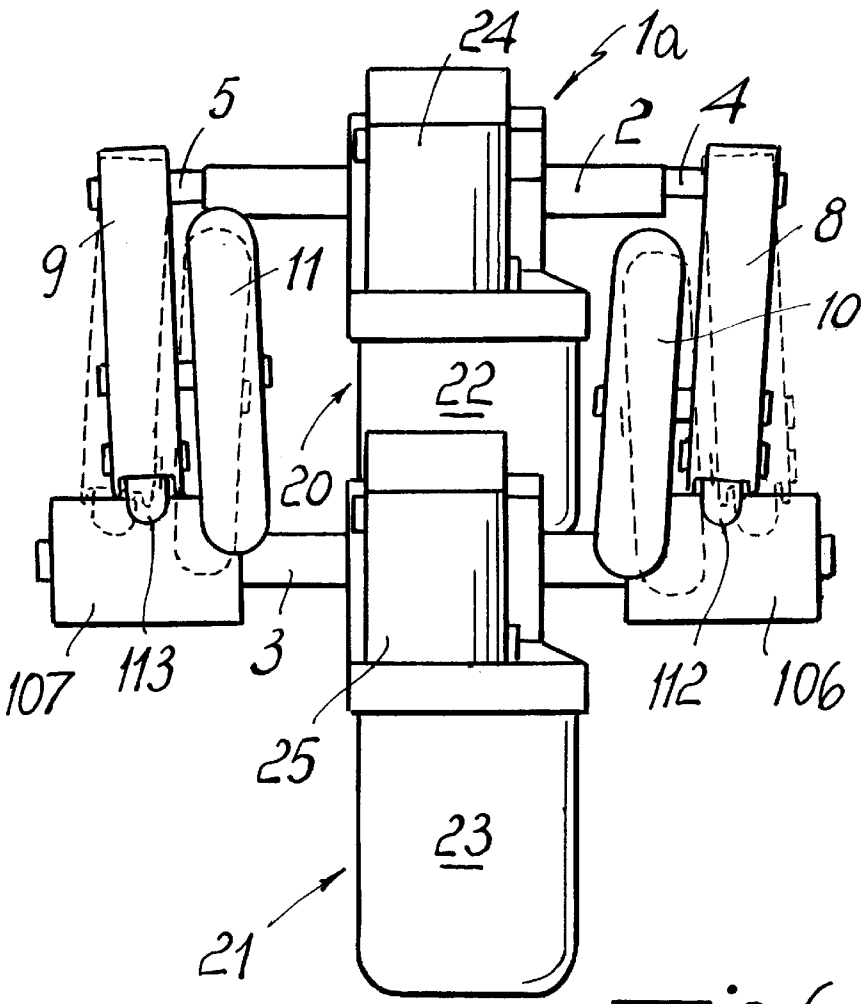
Figure 8:
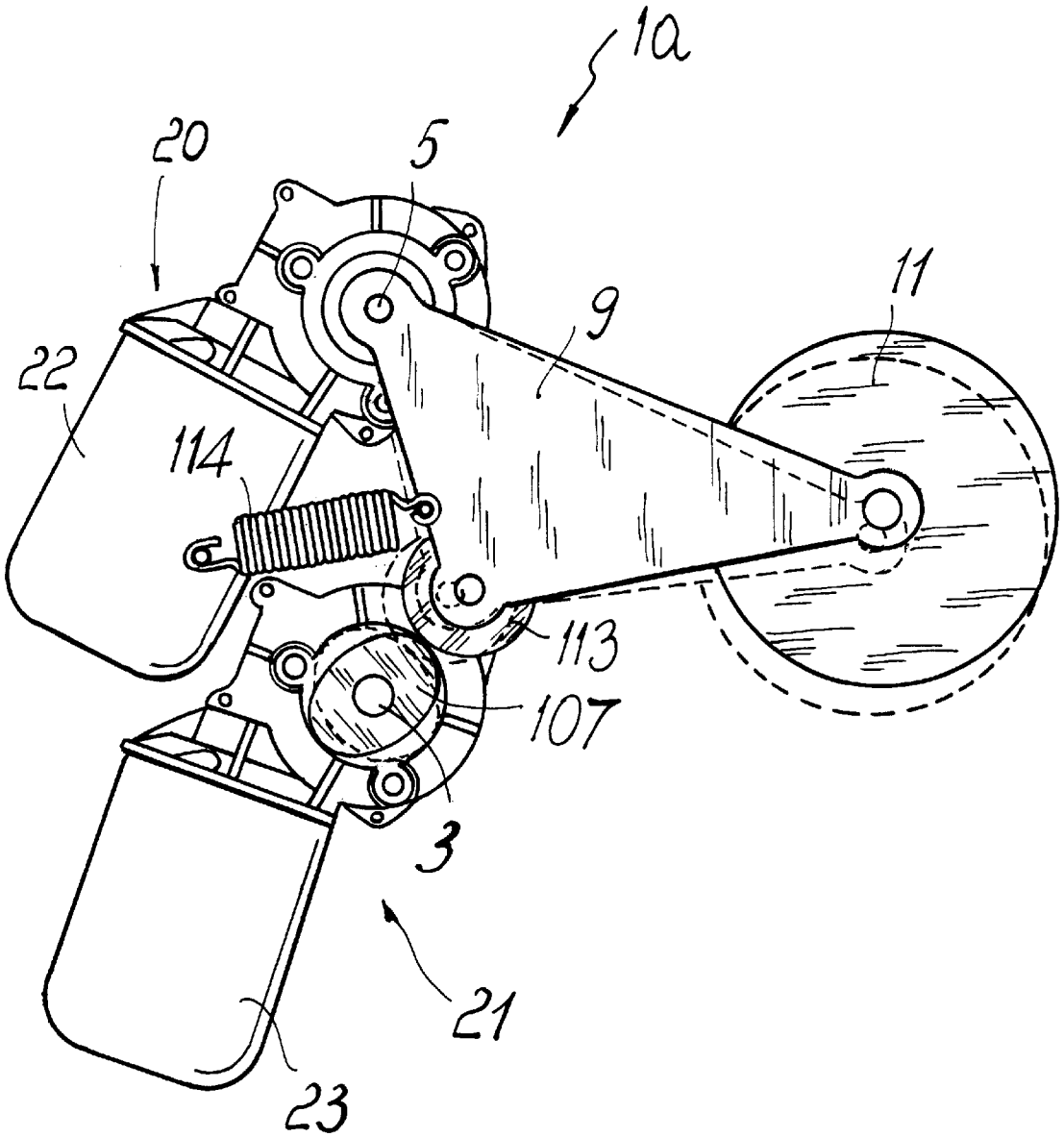

By actuating the upper gearmotor 20, the upper shaft 2 is rotated about its own axis 2*a*. As a consequence of this rotation and of the eccentricity of the portions 4 and 5, the arms 8 and 9 and the massage wheels 10 and 11 are actuated mainly with an oscillating motion about an axis passing through the intersection between the axis 4*a*, 5*a* of the corresponding eccentric portion 4, 5 and the axis 2*a*, producing for the massage wheels 10 and 11 a predominantly horizontal motion, as shown in particular in FIGS. 3, 4, and 6, and performing the massage known as "stretching".

It should be noted that the horizontal oscillating motion of the massage wheels 10 and 11 is allowed by the articulation of the linkages 12 and 13 about the axes 18, 19 for the device according to the first embodiment and by the simple contact connection provided between the arms 7 and 8 and the cams 106 and 107 for the device in its second embodiment.

The actuation of the lower gearmotor 21 causes the rotation of the lower shaft 3 about its own axis. As a consequence of this rotation and of the presence of the eccentric portions 6, 7 and 106, 107, which, by means of the linkages 12, 13 or the cam followers 112, 113, are connected to the arms 8 and 9, the massage wheels 10 and 11 move predominantly in a vertical direction, as shown in particular in FIGS. 1, 2, 7, and 8, providing so-called "tapping" massage.

The angular offset of the eccentric portions 6, 7, 106 and 107 causes the wheel 11 to move downwards as the wheel rises, and viceversa.

Moreover, the particular elliptical configuration of the cams 106 and 107 of the device in its second embodiment allows, at each turn of the lower shaft 3, two cycles of motion of the wheels 10 and 11 in a predominantly vertical direction, thus achieving the further advantage of being able to actuate the motor 23 at a lower speed.

It should be noted that the motors 22 and 23, as mentioned, can be actuated simultaneously, so as to effectively perform at the same time the two stretching and tapping massage functions.

In practice it has been observed that the device according to the present invention fully achieves the intended aim and objects, since it is capable of simultaneously performing the two massages, namely stretching and tapping, also ensuring particularly quiet operation.

A further advantage is that it is possible to use motors having lower power ratings, with a consequent reduction in production costs.

The massaging device thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

What is claimed is:

1. A massaging device for insertion in the back of massage chairs, comprising: an upper shaft and a lower shaft having parallel and substantially horizontal axes and respective eccentric portions; two arms, each whereof supports a massage wheel which is rotatable about its own axis; each of said arms supporting, proximate to one of ends thereof, the corresponding massage wheel and being connected, proximate to an opposite end, to one of said eccentric portions of said upper shaft and, at an intermediate region, to one of said eccentric portions of said lower shaft; means being provided for rotating said shafts about said respective parallel and substantially horizontal axes for an alternating movement of said massage wheels in a substantially horizontal direction and in a substantially vertical direction, said means for rotating said shafts comprising an upper gearmotor which actuates said upper shaft and a lower gearmotor which actuates said lower shaft, wherein said upper and said lower gearmotors are constituted by an electric motor and by a reduction unit with a worm screw which is connected to a shaft of the electric motor and a helical gear which meshes with said worm screw and is connected respectively to an intermediate portion of said upper shaft and to an intermediate portion of said lower shaft.

2. The device according to claim 1, wherein said eccentric portions of the upper shaft have, in a transverse cross-section, a circular shape in which the center is spaced with respect to the axis of the upper shaft.

3. The device according to claim 1, wherein said eccentric portions of the upper shaft have an axis which is spaced from the axis of the upper shaft and is inclined with respect to the axis of the upper shaft.

4. The device according to claim 1, wherein axes of said eccentric portions of the upper shaft are spaced on the same side with respect to the axis of said upper shaft.

5. The device according to claim 1, wherein the eccentric portions of the lower shaft have, in a transverse cross-section, a circular shape wherein the center is spaced with respect to the axis of the upper shaft.

6. The device according to claim 1, wherein axes of the eccentric portions of the lower shaft are spaced with respect to the axis of said lower shaft, with a mutual angular offset of substantially 180° about the axis of said upper shaft.

7. The device according to claim 1, wherein each one of said arms is connected to one of said eccentric portions of said lower shaft by a linkage which is pivoted to the corresponding arm with one of ends thereof about an axis which is substantially parallel to the own axis of the corresponding massage wheel, said linkage being connected to said eccentric portion of the lower shaft by means of a spherical joint and being composed of two portions which are articulated to each other, in an intermediate region of extension of said linkage, about an axis which is substantially perpendicular to a pivoting axis of said linkage to said arm, so as to vary a useful length of the linkage and allow lateral oscillation of the corresponding arm and of the corresponding massage wheel about an axis passing through the intersection between the axis of the corresponding eccentric portion of the upper shaft and the axis of said upper shaft.

8. The device according to claim 1, wherein said eccentric portions of said lower shaft are constituted by cams connected to said lower shaft and engaged by a cam follower which is connected to the corresponding arm of said pair of arms.

9. A massaging device for insertion in the back of massage chairs, comprising: an upper shaft and a lower shaft having parallel and substantially horizontal axes and respective eccentric portions; two arms, each whereof supports a massage wheel which is rotatable about its own axis; each of said arms supporting, proximate to one of ends thereof, the corresponding massage wheel and being connected, proximate to an opposite end, to one of said eccentric portions of said upper shaft and, at an intermediate region, to one of said eccentric portions of said lower shaft; means being provided for rotating said shafts about said respective parallel and substantially horizontal axes for an alternating movement of said massage wheels in a substantially horizontal direction and in a substantially vertical direction, said means for rotating said shafts comprising an upper gearmotor which actuates said upper shaft and a lower gearmotor which actuates said lower shaft, wherein each one of said arms is connected to one of said eccentric portions of said lower shaft by a linkage which is pivoted to the corresponding arm with one of ends thereof about an axis which is substantially parallel to the own axis of the corresponding massage wheel, said linkage being connected to said eccentric portion of the lower shaft by means of a spherical joint and being composed of two portions which are articulated to each other, in an intermediate region of extension of said linkage, about an axis which is substantially perpendicular to a pivoting axis of said linkage to said arm, so as to vary a useful length of the linkage and allow lateral oscillation of the corresponding arm and of the corresponding massage wheel about an axis passing through the intersection between the axis of the corresponding eccentric portion of the upper shaft and the axis of said upper shaft.

10. The device according to claim 9, wherein said upper and said lower gearmotors are constituted by an electric motor and by a reduction unit with a worm screw which is connected to a shaft of the electric motor and a helical gear which meshes with said worm screw and is connected respectively to an intermediate portion of said upper shaft and to an intermediate portion of said lower shaft.

11. The device according to claim 9, wherein said eccentric portions of the upper shaft have, in a transverse cross-section, a circular shape in which the center is spaced with respect to the axis of the upper shaft.

12. The device according to claim 9, wherein said eccentric portions of the upper shaft have an axis which is spaced from the axis of the upper shaft and is inclined with respect to the axis of the upper shaft.

13. The device according to claim 9, wherein axes of said eccentric portions of the upper shaft are spaced on the same side with respect to the axis of said upper shaft.

14. The device according to claim 9, wherein the eccentric portions of the lower shaft have, in a transverse cross-section, a circular shape wherein the center is spaced with respect to the axis of the upper shaft.

15. The device according to claim 9, wherein axes of the eccentric portions of the lower shaft are spaced with respect to the axis of said lower shaft, with a mutual angular offset of substantially 180° about the axis of said upper shaft.

16. The device according to claim 9, wherein said eccentric portions of said lower shaft are constituted by cams connected to said lower shaft and engaged by a cam follower which is connected to the corresponding arm of said pair of arms.

* * * * *